US009522777B2

(12) United States Patent
Yue et al.

(10) Patent No.: US 9,522,777 B2
(45) Date of Patent: Dec. 20, 2016

(54) PACKAGING BOX

(71) Applicant: Shenzhen China Star Optoelectronics Technology Co., Ltd., Shenzhen, Guangdong (CN)

(72) Inventors: Liang Yue, Guangdong (CN); Shihhsiang Chen, Guangdong (CN); Yuchun Hsiao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 250 days.

(21) Appl. No.: 14/386,958

(22) PCT Filed: Sep. 9, 2014

(86) PCT No.: PCT/CN2014/086157

§ 371 (c)(1),
(2) Date: Sep. 22, 2014

(87) PCT Pub. No.: WO2016/033814

PCT Pub. Date: Mar. 10, 2016

(65) Prior Publication Data

US 2016/0244244 A1 Aug. 25, 2016

(30) Foreign Application Priority Data

Sep. 4, 2014 (CN) ..... 2014 1 0449197

(51) Int. Cl.
*B65D 85/00* (2006.01)
*B65D 85/48* (2006.01)
(Continued)

(52) U.S. Cl.
CPC ..... *B65D 85/48* (2013.01); *B65D 25/30* (2013.01); *B65D 81/3816* (2013.01)

(58) Field of Classification Search
CPC ..... B65D 25/30; B65D 11/28; B65D 1/48; B65D 1/42; B65D 5/441; B65D 5/443; B65D 1/34; B65D 1/46; B65D 5/445; B65D 5/448; B65D 81/127; B65D 81/3816; B65D 85/48; H05K 13/0084; H01L 21/67333; H01L 21/6734
(Continued)

(56) References Cited

U.S. PATENT DOCUMENTS 3,451,452 A * 6/1969 Marshall ..... B65D 90/02 220/646
8,662,308 B2 * 3/2014 Yoshizawa ..... H01L 21/673 206/454
(Continued)

FOREIGN PATENT DOCUMENTS

CN 103174913 A 6/2016
DE 4218084 C1 8/1993

*Primary Examiner* — Jacob K Ackun
*Assistant Examiner* — Rafael Ortiz
(74) *Attorney, Agent, or Firm* — Andrew C. Cheng

(57) ABSTRACT

A packaging box includes two side plates disposed oppositely, and each of the side plates provided with an inward recession; and two engaged-embedded parts disposed oppositely; wherein, the inward recession is matched with the engaged-embedded part, and the engaged-embedded part is placed into the inward recession. A cross-sectional shape of the engaged-embedded part is a trapezoid shape, and one acute angle of the trapezoid shape faces toward a top of the side plate. When moving the packaging box, the mechanical arm can embed into the engaged-embedded part. The engaged-embedded part formed by a hard-rigid material can prevent the mechanical arm from damaging the packaging box to reduce the waste of the packaging material. Besides, the cross-sectional shape of the engaged-embedded part is a
(Continued)

trapezoid shape so that when the mechanical arm clamps the packaging box, the packaging box is not easily to drop in order to prevent the loss.

12 Claims, 2 Drawing Sheets

(51) Int. Cl.
*B65D 25/30* (2006.01)
*B65D 81/38* (2006.01)

(58) Field of Classification Search
USPC ..... 206/701, 724, 454, 453, 722, 723, 706, 206/707, 708, 710, 523, 596, 449, 455, 206/557, 564, 565, 559, 725; 220/675, 220/669, 645, 646, 651, 732, 647; 248/345.1, 686, 604, 248/903
See application file for complete search history.

(56) References Cited

U.S. PATENT DOCUMENTS

2013/0341240 A1* 12/2013 Chen ..... B65D 81/133 206/722
2014/0202909 A1* 7/2014 Kuo ..... B65D 85/48 206/453
2014/0262927 A1* 9/2014 Guo ..... B65D 81/056 206/706
2015/0151870 A1* 6/2015 Shin ..... B65D 1/34 206/557

* cited by examiner

PACKAGING BOX

BACKGROUND OF THE INVENTION

Field of the Invention

The present invention relates to the field of transportation, and more particularly relate to a packaging box.

Description of Related Art

In the production of the liquid crystal display (LCD), the production of the LCD includes an assembly process. That is, a liquid crystal panel, a main control circuit, an outer case, and other components are assembled. Each component is required to be finished and well-sealed up until the subsequent assembly into an entire LCD. Wherein, after the liquid crystal panel is produced, the liquid crystal panel is sealed and stored in a packaging box. Then the packaging box is transported to a corresponding assembly station.

When packaging each of the components, a foamed packaging box having certain strength is usually utilized to package the liquid crystal panel. FIG. 1 is a schematic diagram of a packaging box for liquid crystal panel according to the prior art. FIG. 2 is a schematic diagram of slipping and loosing of the packaging box when using a mechanical arm to move the packaging box. With reference to FIG. 1 and FIG. 2, the package box for liquid crystal panel includes a case body 200, and an inward recession 100 disposed at two opposite outer side walls of the case body 200. A mechanical arm 300 or a human hand clamps and holds the packaging box through the inward recession 100 disposed at two opposite outer side walls of the case body 200. Because the packaging box for liquid crystal panel is made of a foamed material, and the foamed material is very soft, the inward recession 100 cannot be designed to be very deep because of the structure limit. Therefore, when moving the packaging box for liquid crystal panel, a bending and deformation is easily generated because of the gravity. The mechanical arm 300 or the human hand used to clamp and hold the packaging box for liquid crystal panel is slipped and loosed from the packaging box. Finally, the packaging box for liquid crystal panel falls down. As shown in FIG. 2, the soft-foamed material cause the mechanical arm 300 break a portion of the packaging box such that the packaging box is damaged so as to generate the waste.

SUMMARY OF THE INVENTION

In order to solve the above problems of the prior art, an object of the present invention is to provide: a packaging box, comprising: two side plates disposed oppositely, and each of the side plates provided with an inward recession; and two engaged-embedded parts disposed oppositely; wherein, the inward recession is matched with the engaged-embedded part, and the engaged-embedded part is placed into the inward recession.

Wherein, a cross-sectional shape of the engaged-embedded part is a trapezoid shape, and one acute angle of the trapezoid shape faces toward a top of the side plate.

Wherein, one terminal of the inward recession is opened; a corner slot is disposed at a corner location of the opened terminal of the inward recession of the packaging box; the packaging box also provided with a limitation embedded part, and the limitation embedded part is inserted at the corner slot.

Wherein, the limitation embedded part includes a corner insertion plate and a limitation block; a side ridge of the limitation block is fixed and integrated with a corner ridge of the corner insertion plate; the corner insertion plate is inserted into the corner slot; an outer surface of the limitation block and a surface of the side plate are aligned and parallel to each other.

Wherein, a bottom of the corner insertion plate and a bottom of the limitation block are aligned and parallel to each other; a top of the corner insertion plate is higher than a top of the limitation block.

Wherein, the engaged-embedded part is made of a steel material or an aluminum-alloy material.

Wherein, the limitation embedded part is made of a foamed material.

When using a mechanical arm to move the packaging box for liquid crystal panel of the present invention, the mechanical arm can embed into the engaged-embedded part. The engaged-embedded part formed by a hard-rigid material can prevent the mechanical arm from damaging the packaging box for liquid crystal panel so as to reduce the waste of the packaging material. Besides, the cross-sectional shape of the engaged-embedded part is a trapezoid shape so that when the mechanical arm clamps the packaging box for liquid crystal panel by the engaged-embedded part, the packaging box is not easily to drop in order to prevent the loss.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the skilled persons of ordinary skill in the art without creative effort, it can also obtain other figures according to these figures. In the figures.

DETAILED DESCRIPTION OF THE PREFERRED EMBODIMENT

The following content combines with the drawings and the embodiment for describing the present invention in detail. It is obvious that the following embodiments are only some embodiments of the present invention. For the skilled persons of ordinary skill in the art without creative effort, the other embodiments obtained thereby are still covered by the present invention. For illustrating clearly, the size and the dimension of an element can be enlarged, and an element using the same reference number always represents for the same or similar element.

Figure 1:
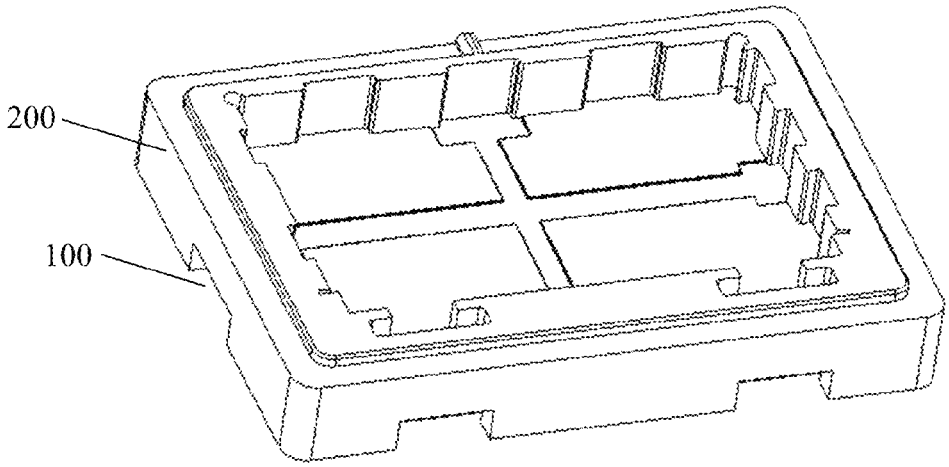
FIG. 1 (Prior art)
FIG. 1 is a schematic diagram of a packaging box for liquid crystal panel according to the prior art.
Figure 2:
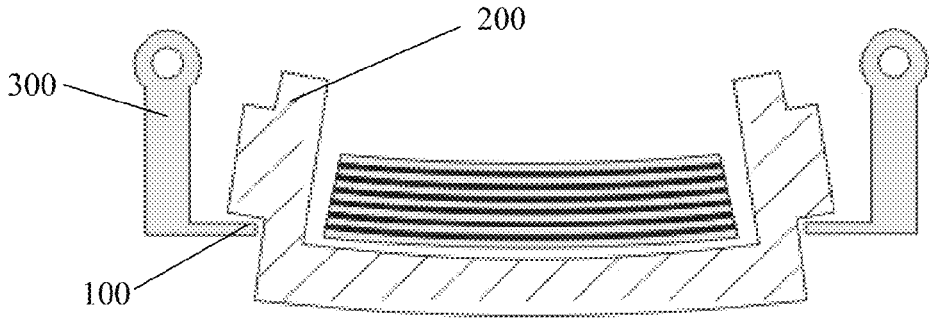
FIG. 2 (Prior art)
FIG. 2 is a schematic diagram of slipping and loosing of the packaging box when using a mechanical arm to move the packaging box.
Figure 3:
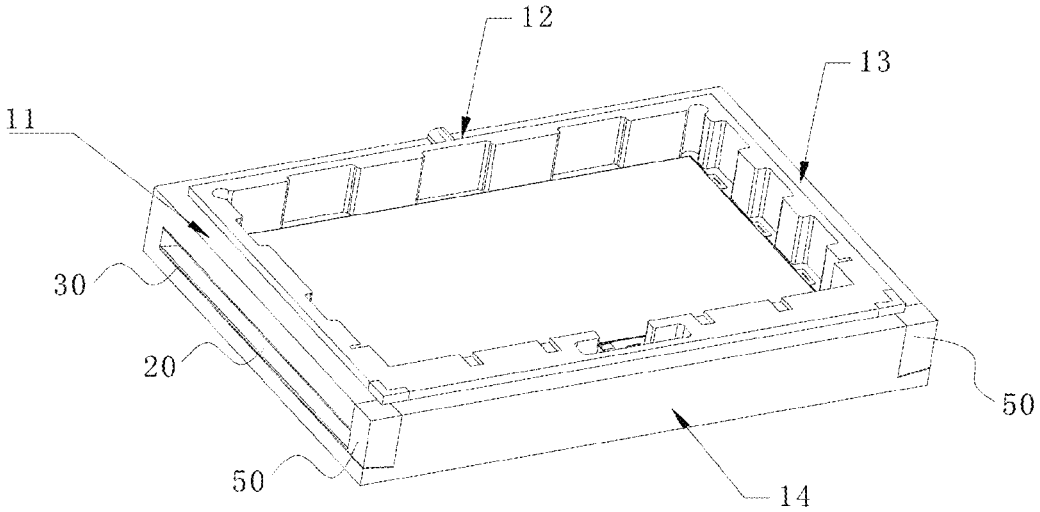
FIG. 3 is a perspective view of the packaging box for the liquid crystal panel after assembled according to an embodiment of the present invention.
Figure 4:
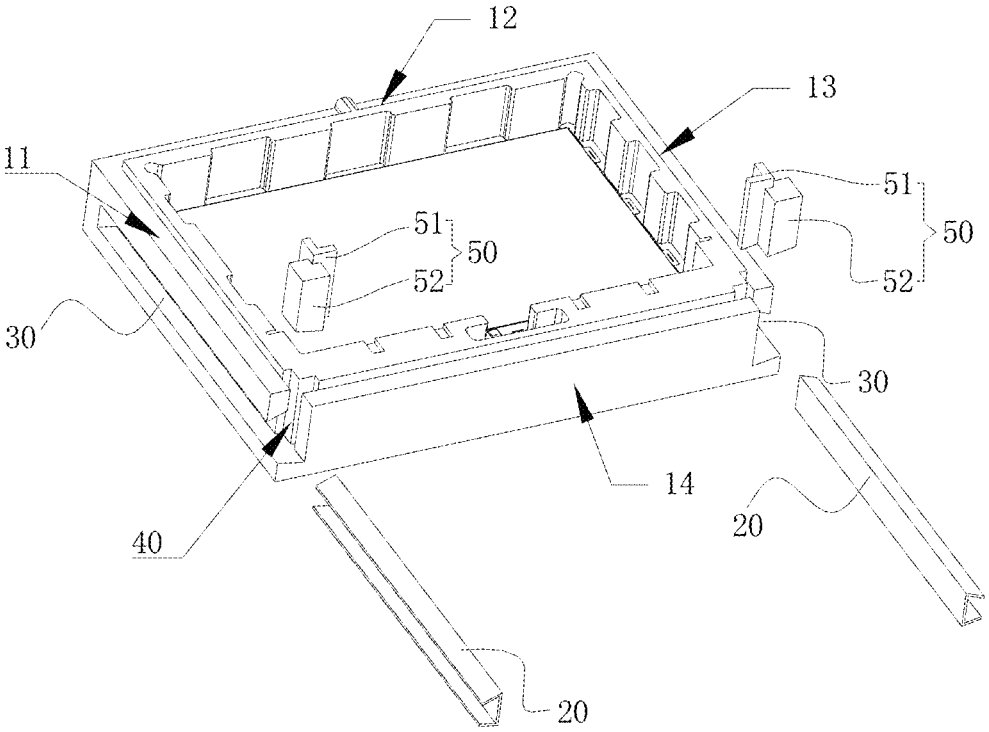
FIG. 4 is an exploded view of each component of the packaging box after disassembled according to an embodiment of the present invention.

FIG. 3 is a perspective view of the packaging box for liquid crystal panel after assembled according to an embodiment of the present invention; FIG. 4 is an exploded view of each component of the packaging box after disassembled according to an embodiment of the present invention; and FIG. 5 is a cross-sectional view of an inward recession of the packaging box according to an embodiment of the present invention.

Figure 5:
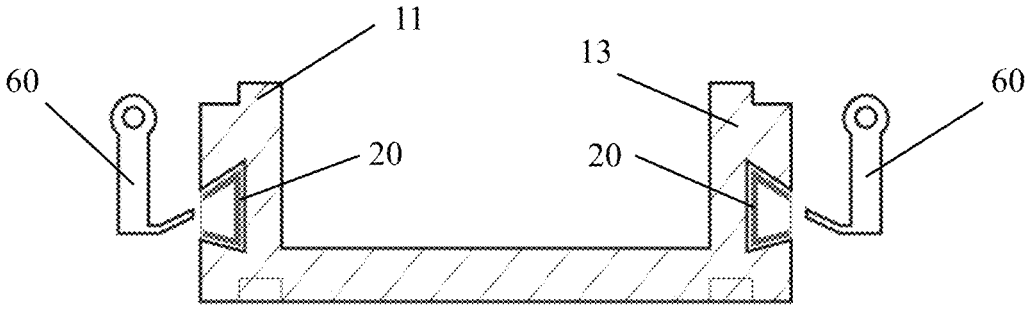
FIG. 5 is a cross-sectional view of an inward recession of the packaging box according to an embodiment of the present invention.

With referring to FIG. 3 to FIG. 5, the packaging box for liquid crystal panel includes: four side plates 11, 12, 13, and 14; two engaged-embedded parts 20. Wherein, the four side plates 11, 12, 13, and 14 are surrounded to form a receiving space. The receiving space is used for placing a liquid crystal panel. The side plate 11 and the side plate 13 are disposed oppositely. The side plate 12 and the side plate 14 are disposed oppositely. Each of the side plate 11 and the side plate 13 is disposed with an inward recession 30 with the shape matched with the engaged-embedded part 20. The engaged-embedded part 20 can be installed into the corresponding inward recession 30. In this embodiment, the engaged-embedded part 20 is made of a hard and rigid material such as a steel plate or an aluminum-alloy material, or other suitable materials. As a result, when a mechanical arm clamps and holds the packaging box for liquid crystal panel, the engaged-embedded part 20 which is made of the hard and rigid material can prevent the mechanical arm from damaging a portion of the packaging box for liquid crystal panel in order to save the cost.

Besides, in another embodiment, each of the side plate 12 and the side plate 14 which are disposed oppositely can also be disposed with the inward recession 30 with the shape matched with the engaged-embedded part 20. Correspondingly, the number of the engaged-embedded parts 20 is four.

In the present embodiment, the cross-sectional shape of the engaged-embedded part 20 is a trapezoidal shape, and an acute angle of the trapezoidal shape faces toward a top surface of the side plate 11 or the side plate 13. As a result, the falling off when a hook arm 60 (shown in FIG. 5) of the mechanical arm clamps and holds the packaging box for liquid crystal panel can be avoided. The cross-sectional shape of the inward recession 30 is also a trapezoidal shape, which matches with the cross-sectional shape of the engaged-embedded part 20 so as to facilitate the engaged-embedded part 20 to be installed into the inward recession 30.

In addition, in order to facilitate the assembly of the engaged-embedded part 20, in this embodiment, a terminal of the inward recession 30 is opened, but the invention is not limited thereto. Therefore, the engaged-embedded part 20 can be inserted into the inward recession 30 through the opened terminal. Besides, in order to prevent the engaged-embedded part 20 from sliding out from the inward recession 30. In this embodiment, a corner slot 40 is disposed at a corner location of the opened terminal of the inward recession 30 of the packaging box for liquid crystal panel. For the above design, the packaging box for liquid crystal panel is provided with a limitation embedded part 50. Wherein, the limitation embedded part 50 is inserted at the corner slot 40 in order to prevent the engaged-embedded part 20 from sliding out from the inward recession 30.

Furthermore, the limitation embedded part 50 includes a corner insertion plate 51 and a limitation block 52. A side ridge of the limitation block 52 is fixed and integrated with corner ridge of the corner insertion plate 51. The corner insertion plate 51 is inserted into the corner slot 40. An outer surface of the limitation block 52 and a surface of the side plate are aligned and parallel to each other. Besides, a bottom of the corner insertion plate 51 and a bottom of the limitation block 52 are aligned and parallel to each other. At the same time, a top of the corner insertion plate 51 is higher than a top of the limitation block 52 in order to conveniently take the limitation embedded part 50 out. At the same time, the above design also meets the design requirement for a protruding platform closed to the inner side of the side plate. Besides, the limitation embedded part 50 can be made of a foamed material.

In summary, when using a mechanical arm to move the packaging box for liquid crystal panel of the present invention, the mechanical arm can embed into the engaged-embedded part. The engaged-embedded part formed by a hard-rigid material can prevent the mechanical arm from damaging the packaging box for liquid crystal panel so as to reduce the waste of the packaging material. Besides, the cross-sectional shape of the engaged-embedded part is a trapezoid shape so that when the mechanical arm clamps the packaging box for liquid crystal panel by the engaged-embedded part, the packaging box is not easily to drop in order to prevent the loss.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A packaging box, comprising:

two side plates disposed oppositely, and each of the side plates provided with an inward recession; and two engaged-embedded parts disposed oppositely;

wherein, the inward recession is matched with the engaged-embedded part, and the engaged-embedded part is placed into the inward recession;

wherein, one terminal of the inward recession is opened; a corner slot is disposed at a corner location of the opened terminal of the inward recession of the packaging box; the packaging box also provided with a limitation embedded part, and the limitation embedded part is inserted at the corner slot.

2. The packaging box according to claim 1, wherein, a cross-sectional shape of the engaged-embedded part is a trapezoid shape, and one acute angle of the trapezoid shape faces toward a top of the side plate.

3. The packaging box according to claim 1, wherein, the limitation embedded part includes a corner insertion plate and a limitation block; a side ridge of the limitation block is fixed and integrated with a corner ridge of the corner insertion plate; the corner insertion plate is inserted into the corner slot; an outer surface of the limitation block and a surface of the side plate are aligned and parallel to each other.

4. The packaging box according to claim 3, wherein, a bottom of the corner insertion plate and a bottom of the limitation block are aligned and parallel to each other; a top of the corner insertion plate is higher than a top of the limitation block.

5. The packaging box according to claim 2, wherein, one terminal of the inward recession is opened; a corner slot is disposed at a corner location of the opened terminal of the inward recession of the packaging box; the packaging box also provided with a limitation embedded part, and the limitation embedded part is inserted at the corner slot.

6. The packaging box according to claim 5, wherein, the limitation embedded part includes a corner insertion plate and a limitation block; a side ridge of the limitation block is fixed and integrated with a corner ridge of the corner insertion plate; the corner insertion plate is inserted into the corner slot; an outer surface of the limitation block and a surface of the side plate are aligned and parallel to each other.

7. The packaging box according to claim 6, wherein, a bottom of the corner insertion plate and a bottom of the limitation block are aligned and parallel to each other; a top of the corner insertion plate is higher than a top of the limitation block.

8. The packaging box according to claim 1, wherein, the engaged-embedded part is made of a steel material or an aluminum-alloy material.

9. The packaging box according to claim 2, wherein, the engaged-embedded part is made of a steel material or an aluminum-alloy material.

10. The packaging box according to claim 3, wherein, the engaged-embedded part is made of a steel material or an aluminum-alloy material.

11. The packaging box according to claim 1, wherein, the limitation embedded part is made of a foamed material.

12. The packaging box according to claim 5, wherein, the limitation embedded part is made of a foamed material.

* * * * *